United States Patent [19]

Burrous

[11] 3,932,294

[45] Jan. 13, 1976

[54] FUNCTIONAL FLUID CONTAINING A HYDROLYSIS SUPPRESSOR

[75] Inventor: Merwyn L. Burrous, El Cerrito, Calif.

[73] Assignee: Chevron Research Company, San Francisco, Calif.

[22] Filed: Jan. 11, 1974

[21] Appl. No.: 432,712

[52] U.S. Cl. ..... 252/78; 252/49.8; 252/49.9; 252/73

[51] Int. Cl.[2] ..... C09K 50/00; C10M 1/10

[58] Field of Search ..... 252/49.8, 49.9, 52, 56, 252/59, 77, 78, 79, 396, 73; 260/340.7

[56] References Cited

UNITED STATES PATENTS

| | | | |
|---|---|---|---|
| 2,862,886 | 12/1958 | Davies et al. | 252/78 |
| 3,513,097 | 5/1970 | Langenfeld | 252/78 |
| 3,538,115 | 11/1970 | Batzer et al. | 260/340.7 |
| 3,637,507 | 1/1972 | Gentit | 252/73 X |
| 3,679,587 | 7/1972 | Smith | 252/78 X |
| 3,707,501 | 12/1972 | Gentit | 252/78 |

*Primary Examiner*—Lorraine T. Kendell
*Attorney, Agent, or Firm*—G. F. Magdeburger; C. J. Tonkin; J. T. Brooks

[57] ABSTRACT

A functional fluid is disclosed which comprises in a mixture a major portion of a base oil and a minor amount of a 2-(3,4-epoxycycloalkyl)-5-5′-spiro-(3,4-epoxy) cycloalkyl-m-dioxane. The fluid may also contain a minor amount of a viscosity index improver, a small amount of water and other additives.

5 Claims, No Drawings

FUNCTIONAL FLUID CONTAINING A HYDROLYSIS SUPPRESSOR

BACKGROUND OF THE INVENTION

Field of the Invention

This application relates to fluid compositions which are useful for transmitting power in hydraulic systems. More particularly, it relates to hydraulic fluids which are susceptible to hydrolysis to form components which are corrosive to the hydraulic system, and a means for controlling such hydrolysis.

Organic phosphate ester fluids have been recognized for some time as advantageous for use as the power transmission medium in hydraulic systems. Such systems include recoil mechanisms, fluid drive power transmissions, and aircraft hydraulic systems. In the latter, phosphate base fluids find particular utility because of their special properties which include high viscosity index, low pour point, high lubricity, low toxicity, low density, and low flammability. Thus, for some years, numerous types of aircraft, particularly commercial jet aircraft, have used phosphate ester fluids in their hydraulic systems. Other power transmission fluids which have been utilized include major or minor amounts of hydrocarbon oils, amides of phosphoric acids, silicate esters, silicones, halogenated hydrocarbons, and polyphenyl ethers. Additives which perform special functions such as viscosity index improvement and foam inhibition are also present in these fluids.

The hydraulic system of a typical modern aircraft contain a fluid reservoir, fluid lines and numerous hydraulic valves which actuate various moving parts of the aircraft such as the wing flaps, ailerons, rudder and landing gear. In order to function as precise control mechanisms, these valves often contain passages or orifices having clearances on the order of a few thousandths of an inch or less through which the hydraulic fluid is passed. In a number of instances, valve orifices have been found to be substantially corroded by the hydraulic fluid. The corrosion of the valve increases the size of the passages and reduces below tolerable limits the ability of the valve to serve as a precision control device. Many aircraft have experienced sagging wing flaps during landings and takeoffs as a result of valve corrosion. The base fluids, particularly the phosphate ester fluids, suffer from the disadvantage that they are susceptible to decomposition at higher temperatures, especially when water is present. The decomposition products are corrosive and thus have a detrimental effect. Consequently, numerous inhibitors have been suggested to enhance the hydrolytic stability of the fluids and thus reduce their corrosiveness.

Numerous patents have issued which disclosed the use of epoxy-type compounds in phosphate hydraulic fluids to react with any corrosive acidic components produced by the hydrolysis of the phosphate fluid. Some of these patents include U.S. Pat. Nos. 2,636,861, 2,862,886, 2,636,862, 2,549,270, 3,478,020, and 3,496,707.

One patent, U.S. Pat. No. 3,637,507, describes a preferred epoxy compound comprising a 3,4-epoxycycloalkyl-3,4-epoxycycloalkyl carboxylate. It is disclosed that this dicyclic diepoxide is preferred to the acyclic epoxides in suppressing hydraulic fluid hydrolysis.

A preferred hydraulic fluid can be prepared by combining with a major portion of a base oil a minor portion of a 2-(3,4-epoxycycloalkyl) -5-5′-spiro-(3,4-epoxy)cycloalkyl-m-dioxane having from 15-45 carbons. These diepoxy dioxanes are believed to have the structural formula

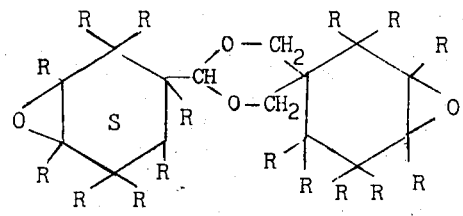

wherein

R is selected from the group consisting of hydrogen and alkyl having from 1–4 carbons (preferably hydrogen).

The diepoxy dioxanes of the above structure can be obtained commercially. For example, 2-(3,4-epoxycyclohexyl)- 5-5′ -spiro-(3,4-epoxy) cyclohexane-m-dioxane can be obtained from Union Carbide Company under brand name ERL-4234.

The amount of diepoxy dioxane which may be employed may range from 0.01 to 8 weight percent of the total composition. Exemplary dioxanes which may be employed along with exemplary preparations are disclosed in U.S. Pat. No. 3,538,115, which is herein incorporated by reference.

The base oil which may be employed can comprise a wide variety of materials, such as organic esters or amides of phosphorus acids, mineral oils, synthetic hydrocarbon oils, halogenated hydrocarbons, oils, silicate esters, silicones, carboxylic acid esters, aromatic halides, esters of polyhydric material, aromatic ethers, methylethers, etc.

The phosphate esters are usually employed as the base fluid in aircraft hydraulic systems and have the formula

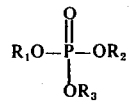

wherein $R_1$, $R_2$ and $R_3$ each represent an alkyl or aryl hydrocarbon group having from 3 to 30 carbons (preferably from 3 to 10 carbons). (As used herein, "aryl" includes aliphatic and alicyclic structures.) All three groups may be the same, or all three different, or two groups may be alike and the third different. A typical fluid will contain at least one species of phosphate ester and usually will be a mixture of two or more species of phosphate esters.

In a particularly preferred embodiment, the hydraulic fluid base consists essentially of a mixture of trialkyl (preferably from 1 to 12 carbons in each alkyl group) and triaryl (preferably from 6 to 15 carbons in each aryl group) phosphate esters with the trialkyl phosphate esters predominating. The trialkyl phosphate esters may be present in amounts of from 70 to 98 percent by weight of the phosphate ester portion of the total fluid composition. Preferably, the trialkyl phosphate esters will comprise 8 to 92 weight percent of the phosphate ester portion of the composition. The trialkyl phosphate esters which give optimum results are those wherein each of the alkyl groups has 1 to 12 carbon atoms and, preferably, has from 4 to 9 carbon atoms. The alkyl groups may each be either a straight-chain or a branched-chain configuration. A single trialkyl phosphate ester may have the same alkyl group in all three positions, or may have two or three different alkyl groups. Mixtures of various trialkyl phosphate esters may also be used. Suitable trialkyl phosphate esters include the tributyl phosphates, particularly tri(n-butyl) phosphate, trihexyl phosphates, and trioctyl phosphates. Particularly preferred are tri-n-butyl phosphate or the branched-chain isomers of the trioctyl phosphates, such as tri(2-ethylhexyl)phosphate.

The triaryl phosphate esters may be present in amounts from about 2 to about 30 percent by weight of the phosphate ester portion of the total fluid composition. The triaryl phosphate esters which give optimum results are those wherein each of the aryl hydrocarbon groups has between 6 and 15 carbon atoms and, preferably, from 6 to 10 carbon atoms. These include phenyl groups and alkyl-substituted phenyl groups. As with the trialkyl phosphates, a single triaryl phosphate may have the same aryl groups in all three positions, or may have a mixture of two or three different aryl groups. Various mixtures of triaryl phosphates may also be used. Suitable triaryl phosphates include triphenyl phosphate, tricresyl phosphate, diphenyl cresyl phosphate, diphenyl xylyl phosphate, diphenyl(ethylphenyl) phosphate, and dicresyl phenyl phosphate. Preferred are those triaryl phosphates wherein at least one aryl group is a monoalkyl-substituted aryl group having one or two carbon atoms in the alkyl group, and preferably one carbon atom in the alkyl group.

The mixed phosphate ester portion of the composition will comprise at least 70 percent by weight of the total composition and, preferably, at least 90 percent by weight of the total composition.

In another embodiment, the base stock can comprise a mixed alkylaryl phosphate ester such as dibutyl phenyl phosphate, butyl diphenyl phosphate, methyl ethyl phenyl phosphate, etc. Particularly preferred is dibutyl phenyl phosphate.

ADDITIVES

The hydraulic fluids generally contain a number of additives which in total comprise 5–25 weight percent of the finished fluid. Among these is water, which may be added intentionally or often becomes incorporated into the fluid during the operations of the system. Such inclusion of water can occur when a hydraulic system is being refilled and is open to the atmosphere, particularly in humid environments. Unintentional incorporation of water may also occur during the manufacturing process of a phosphate fluid. In practice, it is recognized that water will be incorporated into the fluid and steps are taken to control the water content at a level in the range of 0.1–1 weight percent of the whole fluid. It is preferred that the water content be in the range of 0.1–0.8 weight percent and more preferably 0.1–0.3 weight percent.

The hydraulic fluid normally contains 0.5–10 weight percent, preferably 5–10 weight percent, of one or more viscosity index improving agents such as alkylstyrene polymers, polymerized organic silicones, or preferably, polyisobutylene, or the polymerized alkyl esters of the acrylic acid series, particularly acrylic and methacrylic acid esters. These polymeric materials generally have a number average molecular weight of from about 2,000 to 300,000.

A suitable aircraft hydraulic fluid may be composed of the following ingredients

| | Concentration (Wt.%) |
|---|---|
| Base Fluid | 70–90 |
| Dioxane | 0.01–5 |
| VI Improver | 0.5–10 |
| Other Additives | .01–15 |

EXAMPLE 1

This example is presented to illustrate the effectiveness of the noncarboxylic dicyclic diepoxides in maintaining a phosphate ester hydraulic fluid at reduced acidity. To demonstrate this effectiveness, various compounded hydraulic oils are subjected to an accelerated hydrolytic test. In this test, closed 26 ml glass vials containing 13 ml of sample hydraulic fluid with about 0.4 weight percent water and 13 ml of air are heated in an oven at 350°F. From time-to-time, a vial is removed from the oven and the ASTM D-974 acid number of its sample is measured. The number of hours required to reach an acid number of 1.5 mg KOH/gm is recorded. The greater the number of hours noted in the test, the better the hydrolytic stability of the hydraulic fluid.

The hydraulic fluid samples are comprised of a base blend of 90 weight percent tributyl phosphate and 10 weight percent tricresylphosphate with 0.45 weight percent water and a sufficient amount of an epoxide to impart an oxirane oxygen content of 0.15 weight percent.

The various samples are subjected to the hydrolytic stability test above with the results reported in the following Table I:

TABLE I

HYDROLYTIC STABILITY TEST

| Test | EPOXIDE | Approximate HOURS TO 1.5 Acid No. |
|---|---|---|
| 1. | (1)EPOXOL 9.5 | 5 |
| 2. | (2)EPON 815 | 4 |
| 3. | Glycidyl Phenyl Ether | 4 |
| 4. | Butyl Glycidyl Ether | 2 |
| 5. | (3)ERL-4221 | 39 |
| 6. | (4)ERL-4234 | 35 |

(1)EPOXOL 9.5 is epoxidized linseed oil and marketed by Swift and Company.
(2)EPON 815 is a glycidyl ether of bis phenol A and marketed by Shell Chemical Company.
(3)ERL-4221 is 3,4 epoxycyclohexylmethyl-3, 4-epoxycyclohexane carboxylate and marketed by Union Carbide Corp.
(4)ERL-4234 is 2-(3,4 epoxycyclohexyl)-5-5′-spiro-(3,4 epoxy) cyclohexane-m-dioxane a cyclic epoxy resin and marketed by Union Carbide Corp.

What is claimed is:

1. A functional fluid comprising an admixture of 1. a major portion of a base oil which is an organic ester or amide of a phosphorous acid, or mixtures thereof, and
2. a minor portion, from 0.01 to 8 weight percent of said fluid, of at least one 2-(3,4-epoxycycloalkyl)-5-5′- spiro-(3,4-epoxy)cycloalkyl-m-dioxane having from 15 to 45 carbon atoms.

2. The functional fluid defined in claim 1 wherein said base oil is a phosphate ester having this formula:

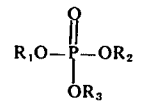

wherein $R_1$, $R_2$, and $R_3$ are alkyl or aryl groups or mixtures thereof having from 3 to 10 carbons.

3. The functional fluid defined in claim 2 wherein said base oil is a mixture of 70–98 weight percent of a trialkyl phosphate ester having from 4 to 9 carbons in each alkyl group and the remainder of a triaryl phosphate ester having from 6 to 15 carbons in each aryl group.

4. The functional fluid defined in claim 3 wherein said trialkyl phosphate is a tributyl phosphate.

5. The functional fluid defined in claim 4 wherein said m-dioxane is 2-(3,4-epoxycyclochexyl)-5-5′-spiro-(3,4-epoxy) cyclohexane-m-dioxane.

* * * * *